US008381317B2

(12) United States Patent
Tipp

(10) Patent No.: US 8,381,317 B2
(45) Date of Patent: Feb. 26, 2013

(54) HELMET ATTACHMENT CLIP

(75) Inventor: Alan Scott Tipp, Bennington, NE (US)

(73) Assignee: Under Armour, Inc., Baltimore, MD (US)

( * ) Notice: Subject to any disclaimer, the term of this patent is extended or adjusted under 35 U.S.C. 154(b) by 302 days.

(21) Appl. No.: 12/620,329

(22) Filed: Nov. 17, 2009

(65) Prior Publication Data

US 2010/0122402 A1 May 20, 2010

Related U.S. Application Data

(60) Provisional application No. 61/115,358, filed on Nov. 17, 2008.

(51) Int. Cl.
*A42B 1/24* (2006.01)

(52) U.S. Cl. ..... 2/422; 24/569

(58) Field of Classification Search ..... 2/422, 424, 2/10, 425, 6.2; D29/122, 110; 24/569, 486; D8/387, 310; 411/409
See application file for complete search history.

(56) References Cited

U.S. PATENT DOCUMENTS

| | | | | | |
|---|---|---|---|---|---|
| 2,973,522 | A | | 3/1961 | Edwards et al. | |
| 3,004,715 | A | * | 10/1961 | Gadd | 238/287 |
| 3,013,320 | A | * | 12/1961 | Miller | 24/569 |
| 3,467,964 | A | * | 9/1969 | Hannan | 2/410 |
| 4,021,858 | A | * | 5/1977 | Neeld et al. | 2/9 |
| 4,028,743 | A | | 6/1977 | Christensen | |
| 4,031,564 | A | | 6/1977 | Wood | |
| D376,713 | S | * | 12/1996 | Kelso | D6/496 |
| D416,060 | S | * | 11/1999 | Angeles | D21/694 |
| 6,079,053 | A | | 6/2000 | Clover, Jr. et al. | |
| 6,189,156 | B1 | | 2/2001 | Loiars | |
| 6,202,266 | B1 | * | 3/2001 | Van den Branden et al. | 24/569 |
| 6,301,719 | B1 | | 10/2001 | Goodhand | |
| D450,569 | S | * | 11/2001 | Chaky | D8/387 |
| D480,951 | S | * | 10/2003 | Robinson | D8/387 |
| D500,897 | S | * | 1/2005 | Herman et al. | D29/122 |
| 6,883,183 | B2 | | 4/2005 | Morrow et al. | |
| 6,934,972 | B2 | | 8/2005 | Desjardins et al. | |
| D604,234 | S | * | 11/2009 | Scott | D12/604 |
| 2008/0250550 | A1 | * | 10/2008 | Bologna et al. | 2/425 |
| 2009/0126063 | A1 | * | 5/2009 | Brown et al. | 2/12 |

FOREIGN PATENT DOCUMENTS

| | | |
|---|---|---|
| CA | 2071294 | * 12/1993 |

* cited by examiner

*Primary Examiner* — Khoa Huynh
*Assistant Examiner* — Anna Kinsaul
(74) *Attorney, Agent, or Firm* — Maginot, Moore & Beck

(57) ABSTRACT

A visor assembly for use with a helmet having at least one face mask bar comprises a visor and a mounting bracket. The visor is configured to provide a shield associated with the face mask bar. The mounting bracket is configured to secure the visor to the face mask bar. The mounting bracket includes a clip and a thumbscrew removably connected to the clip. The clip defines a channel configured to receive the face mask bar. A threaded receptacle is positioned on the clip. The thumbscrew includes a threaded post connected to a thumbwheel. The threaded post is configured to threadedly engage the receptacle of the clip and releasably retain the thumbscrew on the clip. The threaded post of the thumbscrew is configured to extend through a hole of the visor and into the receptacle. When the thumbwheel is rotated, the thumbwheel clamps the visor between the thumbwheel and the mounting bracket.

20 Claims, 6 Drawing Sheets

HELMET ATTACHMENT CLIP

CROSS-REFERENCE TO RELATED APPLICATIONS

This application claims priority from U.S. provisional patent application No. 61/115,358, filed Nov. 17, 2008, the content of which is incorporated by reference herein in its entirety.

FIELD

This application relates to the field of sports equipment and particularly to attachments such as visors for mounting on protective helmets.

BACKGROUND

Football players and other athletes who use helmets sometimes attach a visor or other accessory to the helmet. Visors are typically attached to the face mask of the helmet. The visor serves as a shield to block foreign objects from passing through the face mask and injuring the athlete. For example, the visor prevents competitor hands and other body parts from passing through the face mask and poking the athlete's eyes or nose. In addition to serving as a shield, the visor may also be tinted to block sunlight from the athlete's eyes. Both tinted and clear visors may comprise a UV resistant material that serves to block harmful UV rays from the athlete's eyes.

Visors are typically secured to the helmet using two clips positioned on opposite sides of the face mask. In order to mount the visor, a right side clip with two parallel arms is pressed onto a bar on the right side of the helmet until a channel in the clip fully engages the bar. A symmetric left side clip is then placed on a bar on the left side of the helmet. The visor is then positioned between the face mask and the helmet. The clips are then aligned with opposing holes in the visor. A screw is passed through each hole and clip combination and into a threaded bushing and washer seated on the outside of the clip. When the screw is tightened, the visor and clip are pinned in place upon the face mask, thus securing the face mask to the helmet. In order to remove the visor from the helmet, a screwdriver must first be located, and then the screw must be completely removed from the clip. Only after the screw is removed can the visor be released from the clip. This process of obtaining a screwdriver and unscrewing the screw from the clip is not only time consuming, but since the clip arrangement includes numerous parts, including the screw and other small parts, these parts may be easily lost when the screw is removed from the clip. Furthermore, because numerous parts and tools are required, installing and removing conventional clips is generally awkward and frustrating. Additionally, the parallel arms of conventional clips may pinch the user's fingers when the clips are slid over the bars of the face mask.

There are several conditions where a visor may need to be quickly and easily removed from the athlete's helmet during a game (or during practice). As a first example, if light conditions change during a game, the athlete may wish to switch from a clear visor to a tinted visor or vice-versa. Second, if weather conditions change during a game and cause the athlete's visor to fog-up or accumulate rain droplets, the athlete's vision may be impaired and the athlete may wish to completely remove the visor. Third, if the athlete is injured on the field, it may be necessary to remove the visor to access the athlete's face. In these injury situations, the athlete's head may need to be immobilized such that the visor must be removed from the player without removing the helmet.

In view of the foregoing, it would be advantageous to provide a mounting arrangement for securing a visor to a helmet that allows the visor to be quickly and easily removed from the helmet without the need for tools. It would also be advantageous if the mounting arrangement allowed the visor to be easily removed from the helmet without the need to remove the helmet from the athlete's head. Furthermore, it would be advantageous if the mechanism for securing the visor to the helmet included a relatively small number of parts compared to conventional mounting arrangements, allowing the parts of the mounting arrangement to be easily kept together and in order. It would also be advantageous if the mounting arrangement was universal such that it could be used with numerous cage sizes and could be applied to either side of a face mask.

SUMMARY

A helmet attachment assembly is disclosed for use with a football helmet having a face mask comprised of a plurality of cage bars. The helmet attachment assembly comprises a visor configured to provide a shield for an upper portion of the face mask, the visor including at least one hole. The helmet attachment assembly also includes a mounting bracket configured to secure the visor to the face mask. The mounting bracket includes a clip and a removable thumbscrew, wherein the clip comprises a channel configured to receive one of the plurality of bars of the face mask, and wherein the clip further comprises a thumbscrew connector configured to engage the thumbscrew and releasably retain the thumbscrew on the clip.

In at least one embodiment, the helmet attachment assembly includes a visor and a face mask bracket configured to engage a portion of the face mask. The face mask bracket includes a thumbwheel and face mask clip. The thumbwheel is in rotatable engagement with the face mask clip, wherein rotation of the thumbwheel in one direction secures the face mask clip on the face mask and rotation of the thumbwheel in an opposite direction releases the face mask clip from the face mask.

In at least one embodiment, the helmet attachment assembly comprises a first material and a second co-molded material that provides a greater degree of cushioning than the first material, wherein the second material is provided in the channel of the clip. The channel is provided as a C-shaped channel that is designed and dimensioned to receive the cage bars of a football face mask.

In at least one embodiment, a threaded post extends from the thumbwheel, the threaded post configured to engage a threaded receptacle in the face mask clip. The periphery of the thumbwheel is knurled with small grooves designed and dimensioned to receive a man's or a woman's fingertips. The interior surface of the thumbwheel is textured and slightly convex to facilitate engagement with the cage bars of a face mask.

The above described features and advantages, as well as others, will become more readily apparent to those of ordinary skill in the art by reference to the following detailed description and accompanying drawings. However, the teachings disclosed herein extend to those embodiments which fall within the scope of any appended claims, regardless of whether such embodiments accomplish one or more of the above-mentioned advantages or include one or more of the above-mentioned features.

DESCRIPTION

Figure 1:
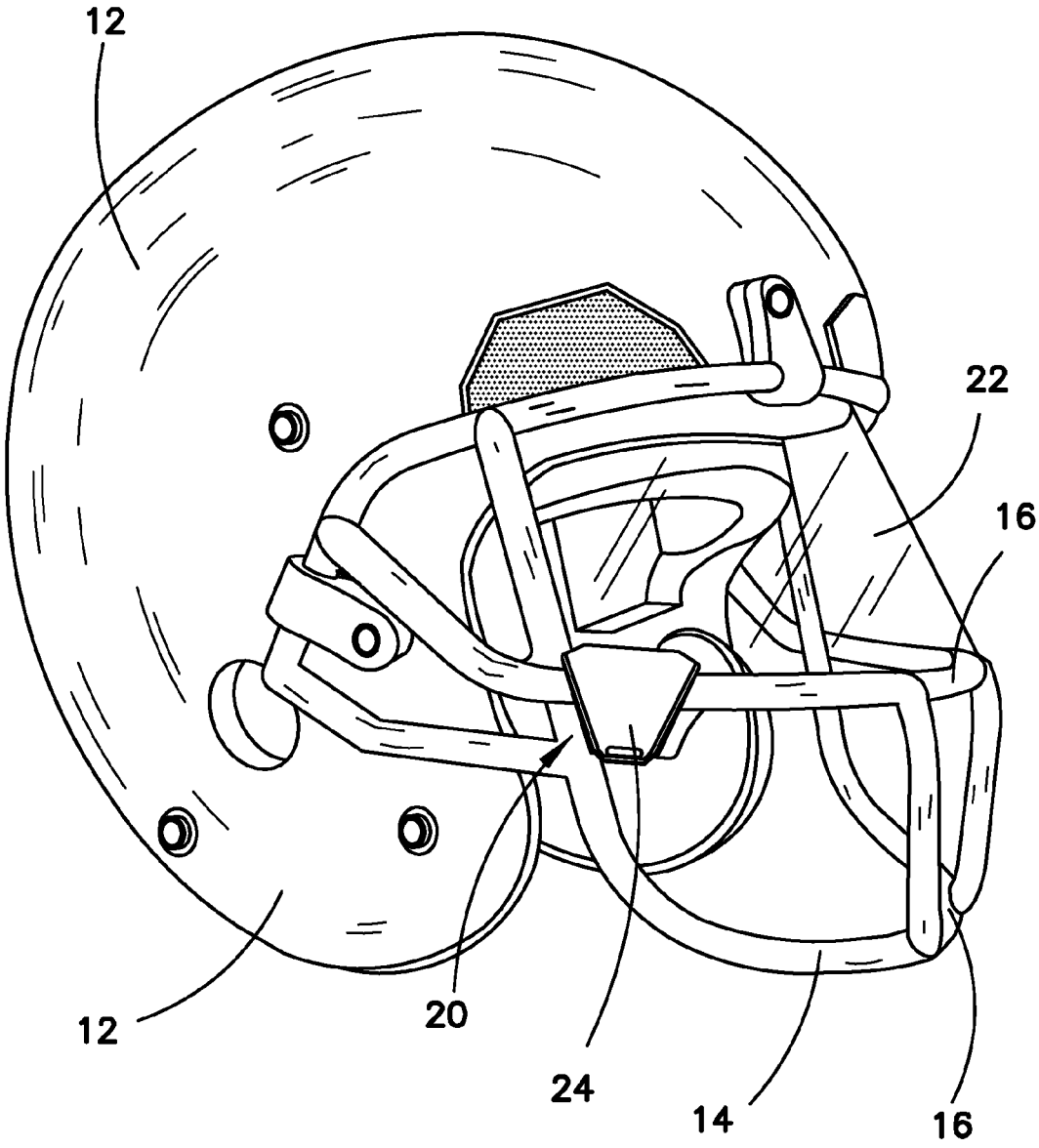
FIG. 1 shows one embodiment of a helmet attachment assembly provided in the form of a visor mounting arrangement for a football helmet.

With reference to FIG. 1, a helmet attachment assembly in the form of a visor assembly 20 is shown mounted on a football helmet 12 with a face mask 14. The visor assembly 20 includes a visor 22 and a mounting bracket 24 configured to secure the visor 22 to the face mask 14. The mounting bracket is secured to the bars 16 which make up the face mask cage. As explained in further detail below, the mounting bracket 24 is generally provided as a two-piece assembly comprising a clip 26 and a fastening member configured for use with a human hand. In at least one embodiment, the fastening member comprises a thumbscrew 28.

Figure 2:
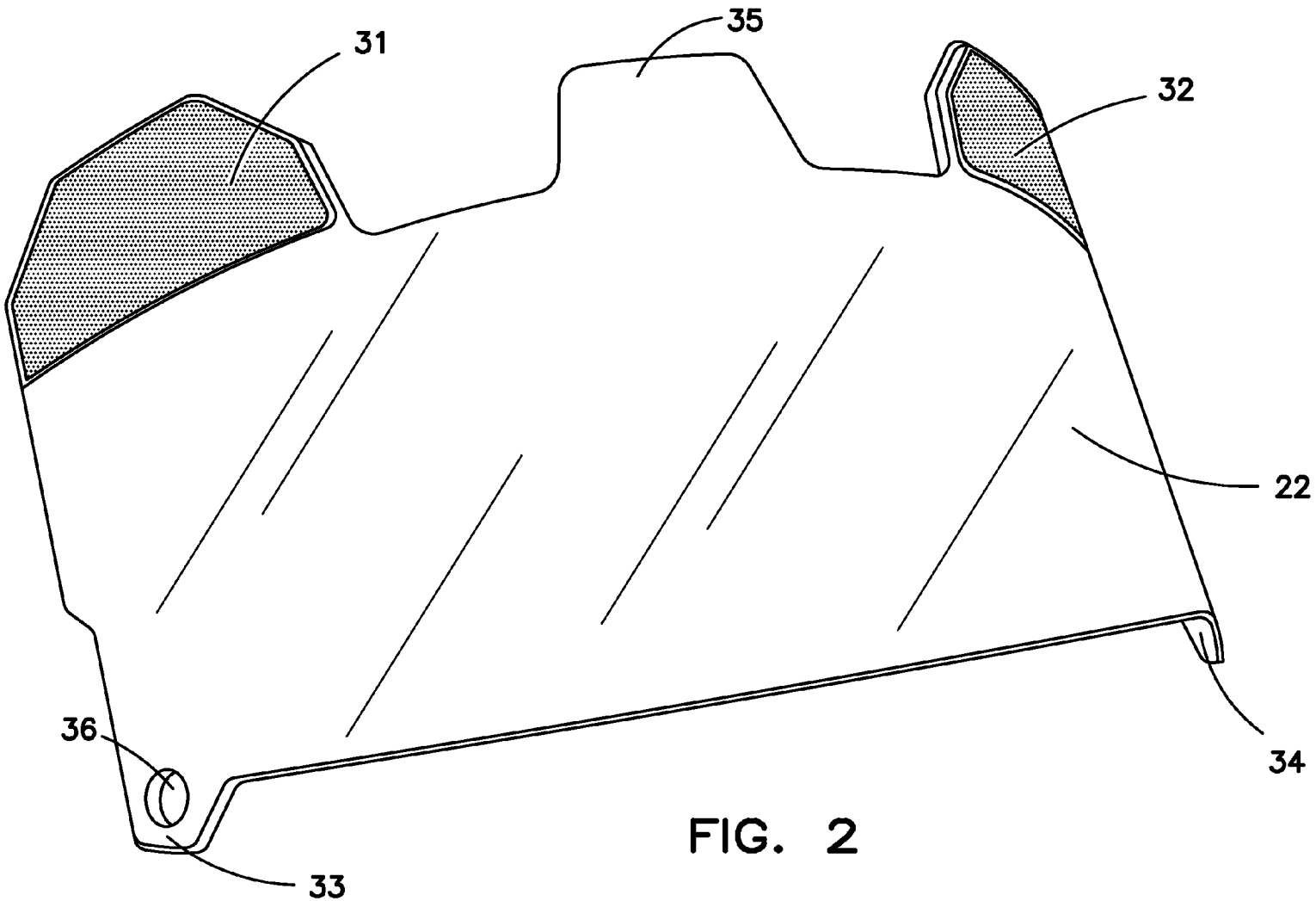
FIG. 2 shows a front view of the visor used with the mounting arrangement of FIG. 1.

With reference now to FIG. 2, the visor 22 is made of a plastic material which allows the athlete to see through the visor. The visor 22 may be clear or tinted to block some amount of light from passing through the visor. The visor 22 includes two upper tab members 31 and 32 and two lower tab members 33 and 34 which extend outward near the corner portions of the visor. The lower tab members 33 and 34 each include a hole 36. The visor also includes a central upper tab member 35. The periphery of the visor 22 is slightly larger than the bars which define an upper cage portion of the face mask 14. This allows the visor 22 to be conveniently positioned between the helmet 12 and the face mask 14 such that the bars 16 of the face mask help keep the visor in place on the helmet. Although the tab members and holes have been shown in a symmetric arrangement in FIG. 2, in at least one alternative embodiment, the holes 36 and/or tab members 31-35 may be provided in an asymmetric pattern.

Figure 3:
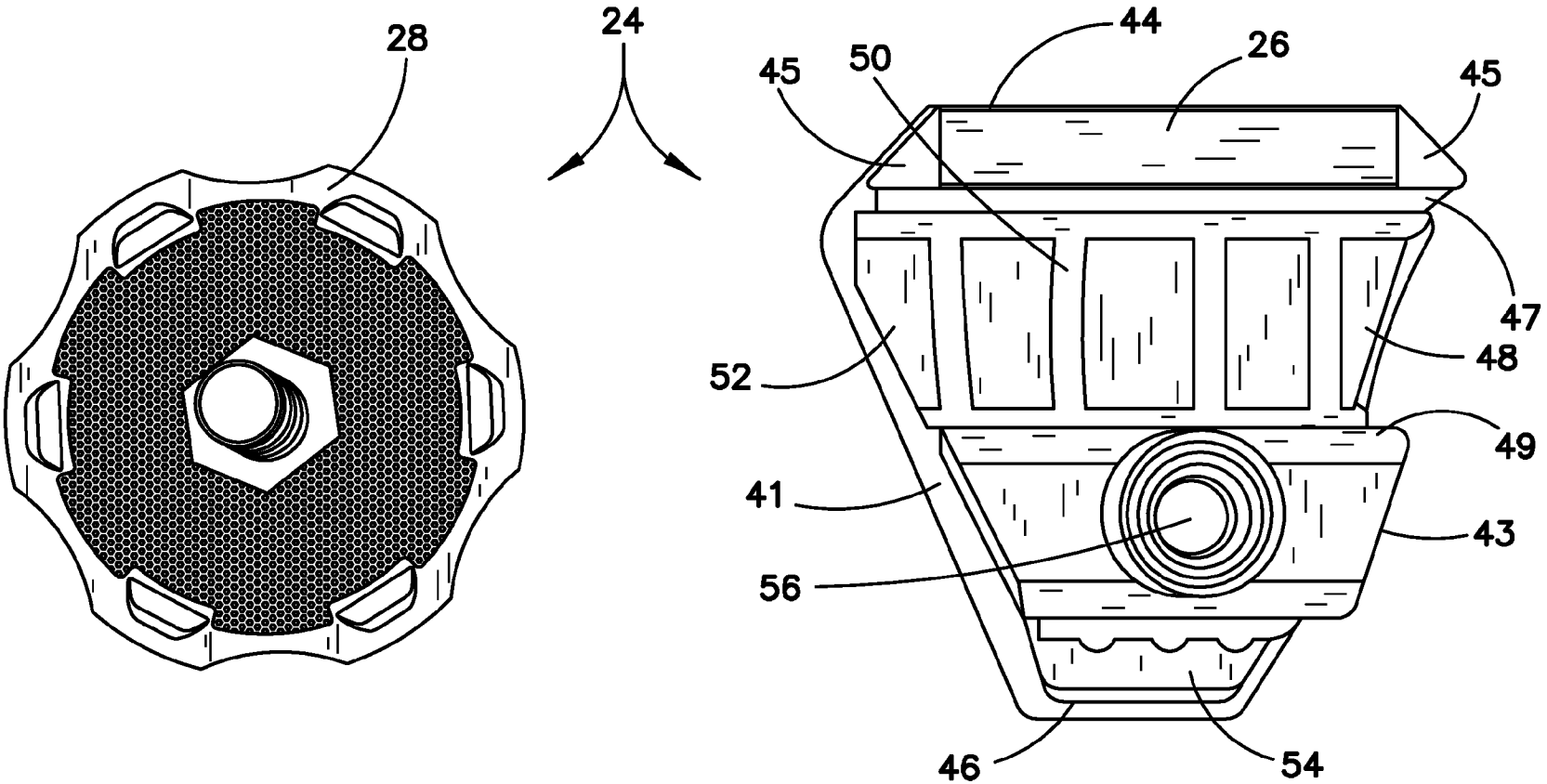
FIG. 3 shows an elevational view of the interior surfaces of a clip and thumbscrew of the visor mounting arrangement of FIG. 1.
Figure 4:
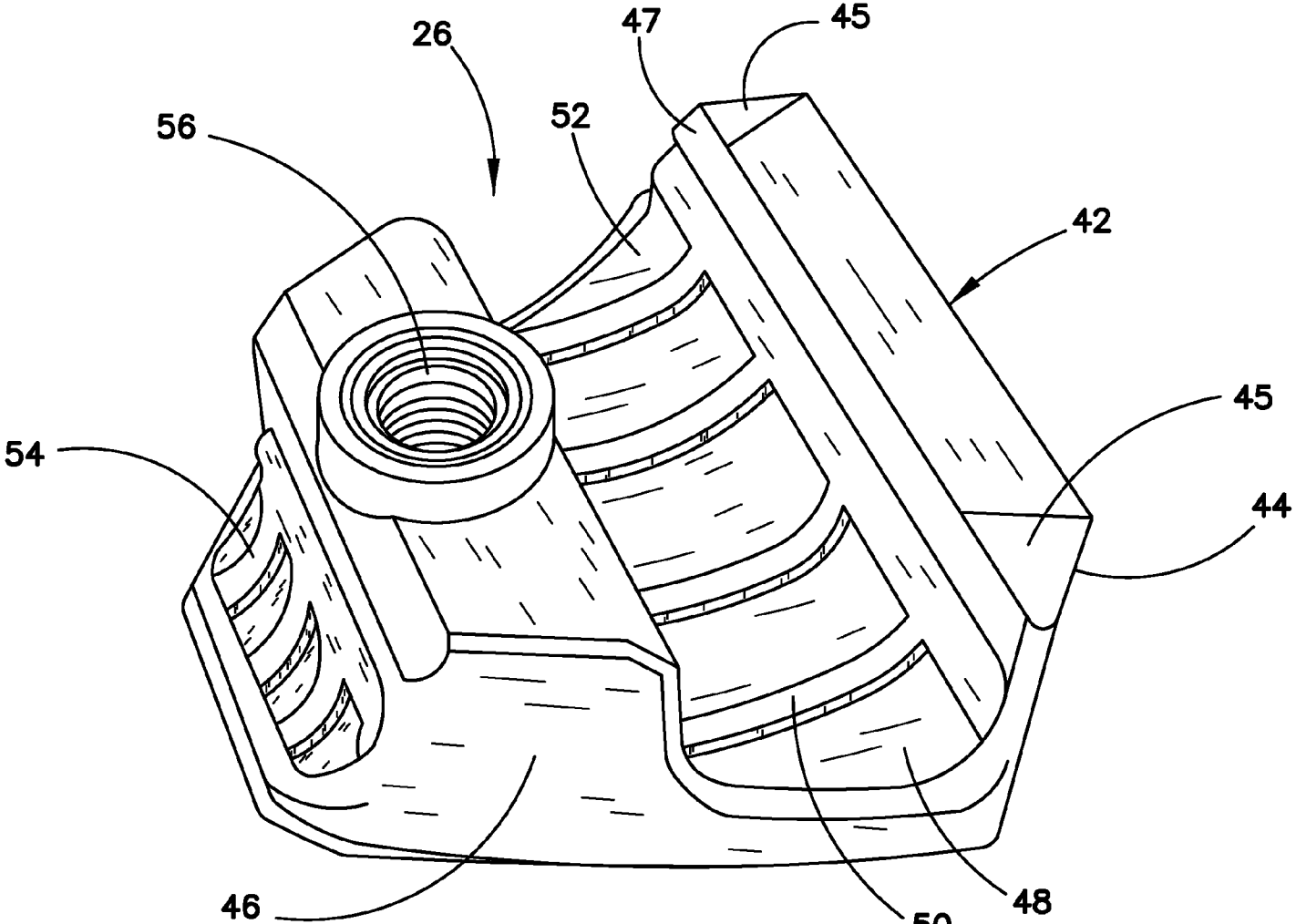
FIG. 4 shows a perspective view of the clip of FIG. 3.
Figure 6:
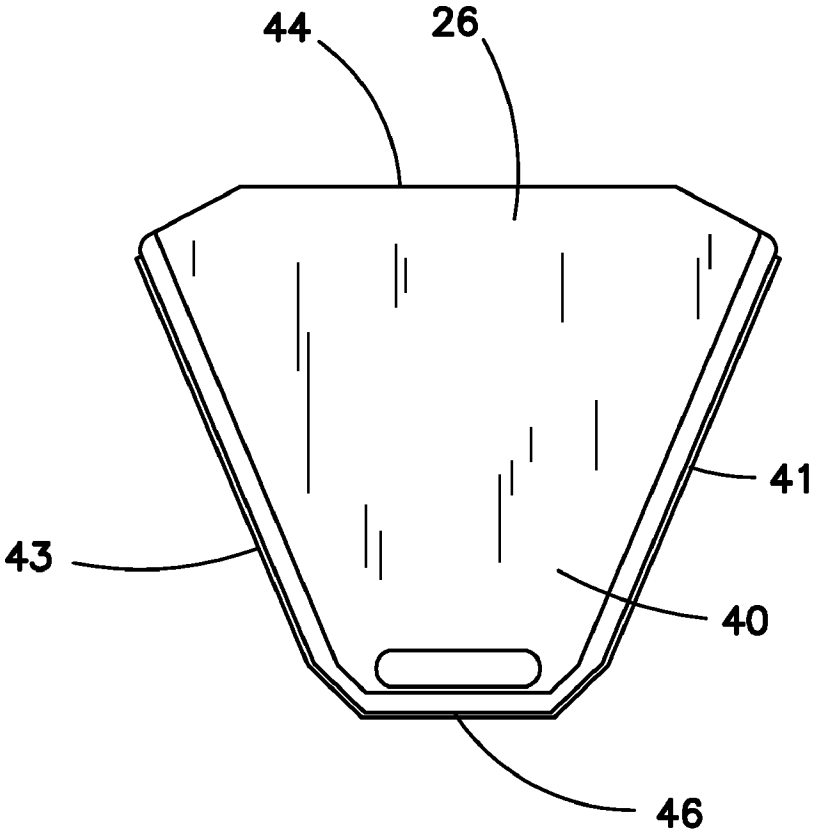
FIG. 6 shows an elevational view of the outer surface of the clip of FIG. 3.
Figure 5:
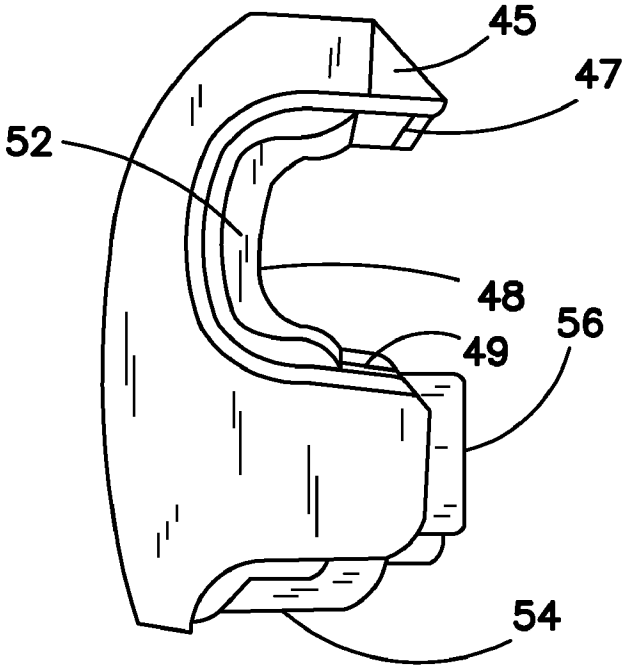
FIG. 5 shows a side elevational view of the clip of FIG. 3.
Figure 7:
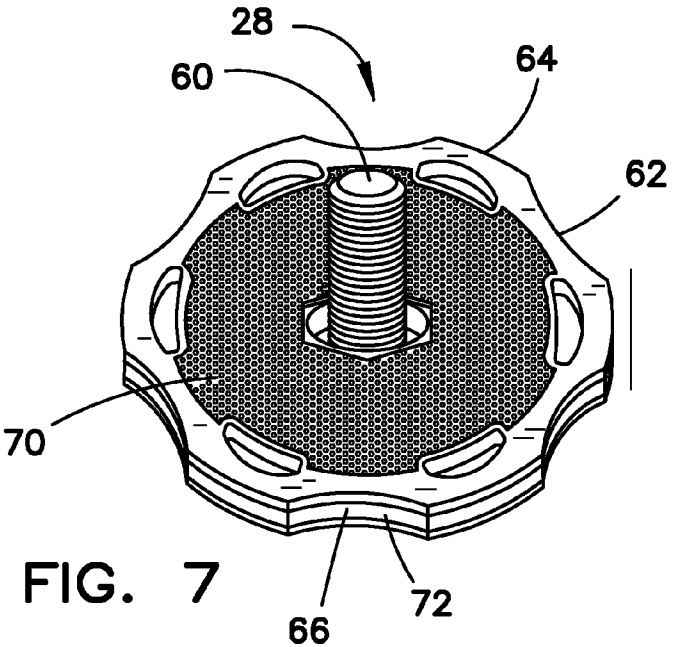
FIG. 7 shows a perspective view of the thumbscrew of FIG. 3.

FIG. 3 shows at least one embodiment of the mounting bracket 24 provided as a two-piece arrangement comprised of a clip 26 and a thumbscrew 28. The clip is shown in further detail in FIGS. 4-6 and the thumbscrew is shown in further detail in FIGS. 7-9.

With particular reference now to FIGS. 3-6, the clip 26 of the mounting bracket 24 is comprised of a relatively hard and rigid polymer material. For example, the clip 24 may be comprised of polyethylene, PVC, or another polymer material. The clip 26 is a substantially flat and smooth outer surface 40 and a contoured inner surface 42. The outer surface 40 of the clip 26 is generally trapezoidal in shape with a longer upper portion 44, a shorter lower portion 46, and slanted sides 41, 43. The outer surface 40 of the clip 26 is designed to face outward from the helmet 12 when the clip is mounted on the helmet.

The contoured inner surface 42 of the clip 26 includes chamfered edges 45 along the longer upper portion 44. A C-shaped channel 48 runs laterally from side-to-side across the upper portion 44 of the clip 26 beneath the chamfered edges 45. The upper wall 47 of the channel 48 is longer than the lower wall 49 of the channel, making the openings at the ends of the channel slightly slanted relative to the walls 47 and 49. This slant defined at the channel openings is the same slant defined along the sides 41, 43 of the trapezoidal shaped clip 26. The slanted sides 41, 43 of the clip 26 generally matches the slant of the vertical bars found on most face mask cages and the vertical edge of the visor, thus allowing the side edge of the clip 26 to be substantially aligned with the face mask bars and visor when mounted on the helmet 12, as shown in FIG. 1. Furthermore, because the slant is provided on both sides 41 and 43 of the clip 26, the clip may be used on either the left or right side of the helmet 12 and still be aligned with the slanted vertical bars of the face mask cage 14.

The C-shaped channel 48 is designed and dimensioned to at least partially receive one of the cage bars of a typical football face mask. Depending on the diameter and depth of the channel 48, the cage bar may be only partially engaging the channel 48 or may be fully seated in the channel 48. The channel 48 includes a plurality of surface irregularities, such as vertical ribs 50, which provide additional gripping ability of the clip 26 against the face mask bar. In at least one embodiment, the surface irregularities are provided by a resilient plastic insert 52 that provides a rubber cushion effect in the C-channel 48. Accordingly, the insert 52 may be comprised of, for example, a polyurethane material or other elastomer material. The resilient quality of the insert 52 allows for compression of the material when various sized face mask cages are secured in the C-channel, and also prevents the cage from slipping in the channel 48. This accommodates varying amounts of vinyl dip coating that manufacturers use on the face mask bars. In at least one embodiment, the insert 54 extends through the lower portion 46 of the clip and provides a lower cushion surface 54 on the bottom of the clip 26.

The lower portion 46 of the clip 26 also includes a threaded receptacle 56. The threaded receptacle 56 may be comprised of a corrosion resistant material to inhibit and prevent rust. In at least one embodiment, the threaded receptacle may be comprised of a metal material, such as steel or a steel alloy. The opening to the threaded receptacle is located adjacent to the lower edge of the C-channel 48. The receptacle 56 is configured to receive a threaded post of the thumbscrew 28, as described in further detail below.

The clip 26 may be formed by any of various methods, including injection molding. The cushion insert 52 may be co-molded with the rest of the clip such that the clip 26 is provided as a single integral component. In this embodiment, the color of the cushion insert may be customized to match that of various teams or school colors. The plastic material of the clip 26 is molded around the receptacle 56 when the clip is formed, thus securing the receptacle in place on the clip 26. The co-molded materials allow for a unified part that is stronger than would be achievable if the different materials were joined with glue or other solvents. In particular, the co-injection molded materials form a stable bond under the heat and pressure of the co-molding process.

With reference now to FIGS. 3 and 7-9, the thumbscrew 28 includes a threaded post 60 extending outward from the center of a hand adjustment member provided in the form of a disc shaped thumbwheel 62. The threaded post 60 may be comprised of a corrosion resistant material. In at least one embodiment, the threaded post is comprised of a metal material, such as steel, similar to the receptacle 56. The thumbwheel may be comprised of a relatively hard polymer material such as, for example, a polyethylene or a poly-vinyl chloride, similar to the clip 26.

The length of the post 60 of the thumbwheel allows for proper engagement and tightening of the thumbscrew 28 in the threaded receptacle 56. In particular, the post 60 is not too long such that it bottoms out in the receptacle 56 before properly tightening the visor on the helmet, as described in further detail below. In addition, the post 60 is not too short such that the threads of the post do not reach or have insufficient holding strength because only a few turns of the thumbscrew is possible before the visor is tightened on the helmet. Accordingly, in at least one embodiment, the post 60 is between 8 mm and 12 mm in length, and the receptacle 56 is a similar depth. In any event, the length of the post and receptacle should generally provide a good post/receptacle combination that allows for face masks of various sizes to be placed in the channel 48 of the clip 26 without allowing the post to bottom out in the receptacle and still allowing for sufficient tightening engagement between the threads on the post 60 and the receptacle 56.

When making a determination for the length of the post, the designer will generally consider the helmet/cage/face mask set-up. In at least one common embodiment, the visor is approximately 2.5 mm thick, offsetting the thumbwheel from the clip by 2.5 mm. As long as the face mask bar fits well within the "c" channel, then a sandwich of parts is created forming a median/baseline measurement. Contributing factors such as the diameter of the vinyl dip coat and obstructions like cage bars will ultimately effect the median measurement plus or minus a few millimeters. A post having a length of 10 mm post + or −2 mm provides a good length when used with a 2.5 mm visor and an 8 mm diameter cage bar. However, in other embodiments the post may be longer, especially if the post must pass through additional elements in addition to the visor, such as a washer or additional clip members before engaging with the receptacle.

The thumbwheel disc 62 includes a knurled perimeter 64 which includes a plurality of concave grooves 66 designed and dimensioned to receive the tips of a human finger or thumb. To facilitate easy rotation of the thumbwheel 62 by the user, the thumbwheel disc 62 is typically between 10 mm and 30 mm in diameter, although it will be recognized that thumbwheels of other diameters are also possible. In at least one embodiment, the thumbwheel 62 is about 20 mm in diameter. The thumbwheel disc 62 also includes a plurality of voids 65 formed in the disc. These voids generally reduce the overall weight of the thumbscrew 28.

Figure 8:
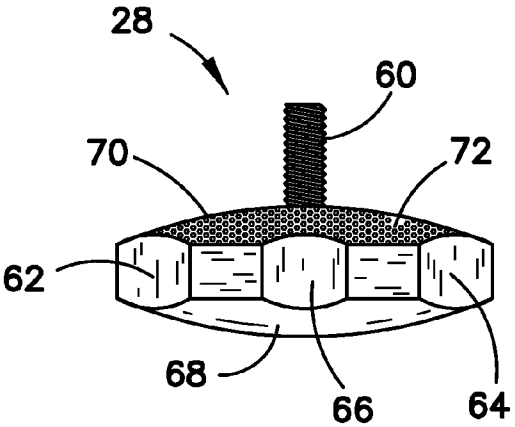
FIG. 8 shows a side elevational view of the thumbscrew of FIG. 3.
Figure 9:
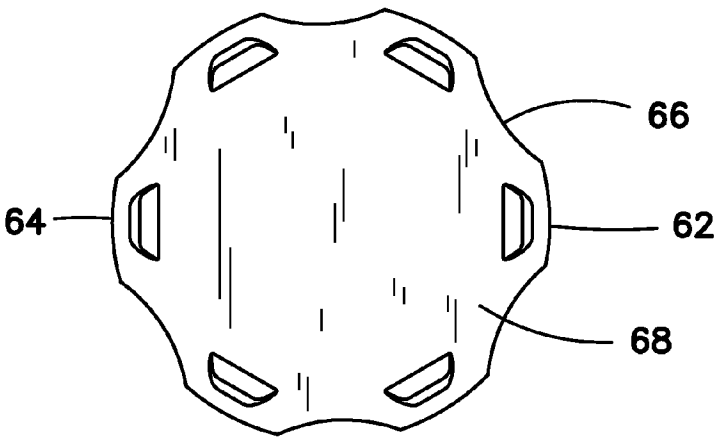
FIG. 9 shows an elevational view of the outer surface of the thumbscrew of FIG. 3.

As best shown in FIG. 8, the outer wall 68 of the thumbwheel disc 62 is convex and substantially smooth. The opposite inner wall 70 of the thumbwheel disc 62 is also convex and includes a plurality of small surface irregularities. The surface irregularities may take the form of a plurality of small bumps 72 provided in numerous rows on the convex surface of the inner wall. The threaded post 60 extends outward from the inner wall 70 of the thumbwheel disc 62.

The small bumps 72 on the inner surface of the thumbwheel 62 are configured to closely engage the visor surface and prevent the threaded post 60 from backing out of the receptacle when the thumbscrew 28 is fastened to the clip 26 and tightened against the visor 22. Advantageously, the convex shape of the thumbwheel inner wall 70 generally compliments the concave inner surface of the visor and prevents the visor from interfering with the visor when the thumbwheel 62 is tightened. In particular, in certain embodiments where the thumbwheel has a generally flat inner wall, the thumbwheel may tend to engage the surface of the visor before the thumbscrew is completely tightened, thus making it difficult to further rotate and completely tighten the thumbscrew. Accordingly, in the embodiment of FIG. 8, the convex shape of the inner wall 70 facilitates rotation and complete tightening of the thumbwheel 62.

Returning again to FIG. 1, the football helmet 12 is shown having the visor 22 secured to the face mask using the mounting bracket 24 described herein. In order to secure the visor 22 to the mounting bracket 24, the user first places the visor 22 between the upper cage bars of the face mask 14 and the helmet 12. Next, the user places the clip 26 on the cage bars 16 located below the eye area by inserting the C-channel 48 of the clip over the outer portion of the cage bar. The user then aligns the receptacle 56 of the clip 26 with the hole 36 in the visor 22. After this, the threaded post 60 of the thumbscrew 28 is inserted through the opposite side of the hole 36 in the visor and into the receptacle 56 of the clip 26. The thumbwheel 62 is then rotated such that the threads of the post 60 engage the threads of the receptacle 56. The user continues to tighten the thumbscrew until the inner convex wall 70 of the thumbwheel 62 is tightly pressed against the visor 22. The convex inner surface 70 of the thumbwheel 62 allows the thumbwheel to continue to turn against the inner surface of the visor even as the thumbwheel 62 is tightened. Furthermore, the gripping bumps 72 on the inner surface 70 of the thumbwheel 62 help prevent the thumbwheel 62 from slipping on the visor and backing out when the thumbscrew is tightened. The process is then repeated with a second clip and thumbscrew on the opposite side of the visor. When the clips 26 and thumbscrews 28 are securely mounted on both the left and right sides of the cage bars, the visor is secured in pace on the helmet.

The size and shape of the thumbwheel 62, including with the fingertip grooves 66, allows the thumbwheel to be easily manipulated by a human hand. Thus, a user may tighten and loosen the thumbscrew 28 when attaching the visor assembly to the helmet without the need for tools. Of course, if desired, tools such as pliers may also be utilized to provide additional tightening or loosening force. In addition, in at least one embodiment, the thumbwheel may include a bit-shaped slot, groove or other tightening feature for use in combination with a screwdriver, wrench or other tool to provide the user with the option of tightening the thumbscrew with additional force.

Advantageously, because both side portions of the clip 26 are slanted as described above, a clip may be used on either the left or right side of the helmet and still align with the slant on the face mask and visor. This configuration allows the mounting brackets 24 to be sold in a kit that includes a visor and two or more identical mounting brackets. With such a kit, the purchaser may conveniently use either clip 26 on the left or right side of the helmet 12 without concern that a clip 26 has been improperly placed on either the left or right side of the helmet. In addition, when used with a double-bar face mask cage, the clip 26 can be positioned on either of the lower bars. The ability to place the clip on different bars allows the user to raise or lower the visor on the helmet to better align the edge of the visor with the edge of the face mask bar and reduce the potential for the edges to interfere with the wearer's line of sight. This is generally in contrast to conventional slip-on type clips that are configured only for use on the top bar of a double bar cage. With such conventional clips, the clip cannot be properly installed between the top bar and the lower bar, and therefore such conventional clips are not designed with the level of adjustment contemplated by the clip 26 described herein.

In addition to the foregoing, it will be recognized that each clip 26 is relatively simple and includes only two distinct parts that are used together to provide the mounting bracket. Accordingly, there are fewer parts that may be lost than in past arrangements. In addition, because the parts are universal, they may be used interchangeably on either side of the helmet.

As set forth in the preceding paragraph, the mounting bracket 24 allows a person to quickly and easily secure the visor 22 to the helmet 12 without necessarily requiring the use of a screwdriver, pliers, or other tools. In addition, the mounting bracket 24 and visor 22 may be conveniently removed from the helmet 12 without the use of tools. In order to remove the mounting bracket 24 and visor 22 from the helmet 12, the user simply rotates the thumbwheel 62 in a counterclockwise direction until the threads of the thumbscrew post 60 are released from the threads of the receptacle 56 on the clip 26. Once the thumbscrew 28 is released from the clip 26, the thumbscrew post 60 is pulled out of the hole 36 in the visor 22, releasing the visor 22 from the mounting bracket 24 and face mask 14.

Although the helmet attachment assembly has been described with respect to the embodiment shown in FIGS. 1-9, it will be appreciated by those of skill in the art that other implementations and adaptations are possible. For example, instead of the fastening member comprising a threaded post, the fastening member could comprise a threaded receptacle that receives a threaded post on the clip. As another example, the fastening member could include a locking post with a spring bearing or cotter pin that is used to secure the fastening member to the clip in lieu of a threaded post. As yet another example, a Clevis pin or a click-lock style clip similar to those found on lanyards, quick release key chains and backpack straps could be used to attach the clip to the face mask. Moreover, there are advantages to individual advancements described herein that may be obtained without incorporating other aspects described above. Therefore, the spirit and scope of the appended claims should not be limited to the description of the preferred embodiments contained herein.

What is claimed is:

1. A visor assembly for use with a helmet having at least one face mask bar, the assembly comprising:

a visor configured to provide a shield associated with the face mask bar, the visor configured to engage a first side of the face mask bar; and a mounting bracket configured to secure the visor to the face mask bar, the mounting bracket including:

a clip including a first threaded member and a channel configured to at least partially receive a second side of the face mask bar, the second side of the face mask bar directly opposite the first side of the face mask bar such that the face mask bar is interposed between the channel of the clip and the visor, and a thumbwheel removably connected to the clip, the thumbwheel including an inner wall and a second threaded member, the second threaded member configured to threadedly engage the first threaded member of the clip and releasably retain the thumbwheel on the clip, and the inner wall of the thumbwheel configured to contact the visor and clamp the visor and face mask bar between the inner wall of the thumbwheel and the clip.

2. The visor assembly of claim 1 wherein the visor includes at least one hole extending therethrough, and wherein the first threaded member is a threaded receptacle and the second threaded member is a threaded post, the threaded post extending through the at least one hole of the visor and into the threaded receptacle when the mounting bracket secures the visor to the face mask bar.

3. The visor assembly of claim 2 wherein rotation of the thumbwheel in one direction moves the inner wall of the thumbwheel toward the visor, and wherein rotation of the thumbwheel in the opposite direction moves the inner wall of the thumbwheel away from the visor.

4. The visor assembly of claim 3 wherein the inner wall of the thumbwheel is convex.

5. The visor assembly of claim 3 wherein the inner wall of the thumbwheel includes a textured surface.

6. The visor assembly of claim 2 wherein the visor includes at least one lower tab and the at least one hole is positioned in the lower tab.

7. The visor assembly of claim 1 wherein the perimeter of the thumbwheel is knurled.

8. The visor assembly of claim 7 wherein the knurled perimeter of the thumbwheel includes a plurality of grooves designed and dimensioned to receive a human's fingertips.

9. The visor assembly of claim 1 wherein the clip comprises an elastomeric material and a relatively rigid material, wherein the elastomeric material is provided in the channel of the clip.

10. The visor assembly of claim 1 wherein the channel includes a plurality of ribs.

11. The visor assembly of claim 1 wherein the at least one face mask bar includes a first face mask bar and a second face mask bar, wherein the channel is configured to receive the first face mask bar and the clip includes at least one side that extends substantially parallel to the second face mask bar.

12. The visor assembly of claim 1 wherein the mounting bracket is a first mounting bracket, the visor assembly further comprising a second mounting bracket that is identical to the first mounting bracket.

13. A clip assembly for connecting a visor to an athletic helmet having at least one face mask bar, the visor configured to engage the face mask bar, the clip assembly comprising: a clip member having a channel designed and dimensioned to engage a first side of the face mask bar; and a fastening member releasably connected to the clip member, the fastening member including a clip-engaging member and a clamping surface, the fastening member configured to selectively secure the fastening member to the clip and release the fastening member from the clip, the clamping surface configured to face the channel and a second side of the face mask bar opposite the first side and trap the face mask bar and the visor between the channel of the clip and the clamping surface when the face mask bar is positioned in the channel and the fastening member is secured to the clip member.

14. The clip assembly of claim 13 wherein the clip-engaging member is a post connected to a hand adjustment member, the post configured to engage a receptacle of the clip member and releasably retain the fastening member on the clip member.

15. The clip assembly of claim 14, wherein the clip member comprises an elastomeric material and a relatively rigid material, wherein the at least one face mask bar contacts the elastomeric material when the channel engages the face mask bar.

16. The clip assembly of claim 14 wherein the hand adjustment member is a thumbwheel and wherein the clip post threadedly engages the receptacle.

17. The clip assembly of claim 16 wherein the clamping surface is provided on an inner wall of the thumbwheel, wherein the visor is positioned between the face mask bar and the inner wall of the thumbwheel, and wherein rotation of the thumbwheel in one direction moves the inner wall of the thumbwheel toward the clip member and rotation of the thumbwheel in the opposite direction moves the inner wall of the thumbwheel away from the clip member.

18. The clip assembly of claim 14 wherein the at least one face mask bar includes a first face mask bar and a second face mask bar, wherein the channel is configured to receive the first face mask bar and the clip member includes slanted sides that extend substantially parallel to the second face mask bar.

19. A mounting bracket for attaching a visor to an athletic helmet having at least one face mask bar, the visor configured to engage the at least one face mask bar, the mounting bracket comprising: a first bracket member including a first locking feature and a first clamping surface configured to contact a first side of the face mask bar; and a second bracket member releasably connected to the first bracket member, the second bracket member including a second locking feature and a hand adjustment member, the hand adjustment member including a second clamping surface positioned directly opposite the first clamping surface when the first locking feature engages the second locking feature with the first clamping surface sufficiently separated from the second clamping surface to receive the at least one face mask bar and the visor between the first clamping surface and the second clamping surface, the hand adjustment member configured to be grasped by a human hand and moved in a first direction that causes the second locking feature to engage the first locking feature and secure the second bracket member to the first bracket member, and the hand adjustment member further configured to be moved in a second direction that causes the second locking feature to disengage the first locking feature and release the second bracket member from the first bracket member.

20. The mounting bracket of claim 19 wherein the first locking feature comprises a clip and the second locking feature comprises a thumbwheel, wherein the thumbwheel includes an inner wall, and wherein rotation of the thumbwheel in one direction moves the inner wall of the thumbwheel toward the clip, and wherein rotation of the thumbwheel in the opposite direction moves the inner wall of the thumbwheel away from the clip.

* * * * *